US008336844B2

(12) United States Patent
Pearce

(10) Patent No.: US 8,336,844 B2
(45) Date of Patent: Dec. 25, 2012

(54) MOUNTING SYSTEM FOR SUPPORTING A CEILING FAN ASSEMBLY

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 801 days.

(21) Appl. No.: 11/700,648

(22) Filed: Jan. 31, 2007

(65) Prior Publication Data

US 2008/0181782 A1 Jul. 31, 2008

(51) Int. Cl.
*H05K 5/02* (2006.01)

(52) U.S. Cl. ..... 248/345; 248/342; 248/343; 248/344; 248/288.31; 416/244 A

(58) Field of Classification Search ..... 248/342, 248/343, 344, 288.31, 345; 416/210 R, 244 R, 416/244 A See application file for complete search history.

(56) References Cited

U.S. PATENT DOCUMENTS

| | | | | |
|---|---|---|---|---|
| 1,193,520 | A * | 8/1916 | Crownfield | 362/277 |
| 1,496,460 | A | 6/1924 | Hofrichter | |
| 2,739,780 | A * | 3/1956 | Richards | 248/324 |
| 2,749,074 | A * | 6/1956 | Bodian | 248/344 |
| 2,907,545 | A * | 10/1959 | Beck et al. | 248/343 |
| 2,951,716 | A * | 9/1960 | Myers | 285/273 |
| 4,448,388 | A * | 5/1984 | Dennis et al. | 248/663 |
| 4,538,973 | A | 9/1985 | Angott et al. | |
| 4,729,725 | A | 3/1988 | Markwardt | |
| 4,878,806 | A | 11/1989 | Markwardt | |
| 5,222,864 | A | 6/1993 | Pearce | |
| 5,507,619 | A | 4/1996 | Ryan | |
| 5,660,363 | A * | 8/1997 | Maglica | 248/288.31 |
| 5,725,190 | A * | 3/1998 | Cuthbertson et al. | 248/343 |
| 5,947,436 | A * | 9/1999 | Bucher et al. | 248/345 |
| 5,988,580 | A | 11/1999 | Bucher et al. | |
| 6,036,154 | A | 3/2000 | Pearce | |
| 6,139,279 | A * | 10/2000 | Pearce et al. | 416/244 R |
| 6,171,061 | B1 | 1/2001 | Hsu | |
| 6,203,279 | B1 * | 3/2001 | Moody et al. | 416/244 R |
| 6,234,757 | B1 * | 5/2001 | Pearce | 416/244 R |
| 6,311,943 | B1 * | 11/2001 | Tang | 248/343 |
| 6,761,540 | B2 * | 7/2004 | Tseng | 416/244 R |

(Continued)

FOREIGN PATENT DOCUMENTS

JP 62271993 A 11/1987

(Continued)

*Primary Examiner* — Terrell McKinnon
*Assistant Examiner* — Michael McDuffie
(74) *Attorney, Agent, or Firm* — Baker Donelson; Dorian B. Kennedy

(57) ABSTRACT

A ceiling fan mounting system (10) is disclosed which includes an upper pre-mounted assembly (12) and a lower hanging assembly (13). The upper pre-mounted assembly includes a mounting plate (14) with a peripheral flange (16) having threaded mounting holes (17) therein. The upper assembly also includes a hanger (21) coupled to the mounting plate and having a stepped ball holding flange (23) with a beveled interior facing surface (24). The lower hanging assembly includes a downrod (29) coupled to a ball joint (31) and a canopy (32). The ball joint is configured to be received within the hanger ball holding flange and has a series of deformable ridges (33). The canopy includes a central opening defined by a central, stepped flange (35) adapted to receive and nest flushly against the exterior of the hanger ball holding flange. The canopy stepped flange fits flushly against the exterior of the hanger ball holding flange so as to encircle the C-shaped holding flange.

9 Claims, 2 Drawing Sheets

U.S. PATENT DOCUMENTS 6,872,054 B2 * 3/2005 Pearce ..... 416/244 R
6,932,578 B2 * 8/2005 Pearce ..... 416/244 R
6,981,678 B2 * 1/2006 Fu-Liang ..... 248/343
7,080,813 B1 * 7/2006 Frampton et al. ..... 248/343
7,100,881 B2 * 9/2006 Worrall ..... 248/278.1
7,249,744 B2 * 7/2007 Bacon et al. ..... 248/343

FOREIGN PATENT DOCUMENTS

JP 01142296 A 6/1989
JP 06088596 A 3/1994

* cited by examiner

MOUNTING SYSTEM FOR SUPPORTING A CEILING FAN ASSEMBLY

TECHNICAL FIELD

This invention relates to a mounting system for supporting a ceiling fan assembly.

BACKGROUND OF THE INVENTION

Ceiling fans have become an increasingly popular supplementary means of creating an airflow within both commercial and residential buildings. Notwithstanding the widespread use of ceiling fans, the installation and subsequent stabilization of ceiling fans during use remains problematic.

With conventional mounting systems, the weight of the ceiling fan assembly, which includes the ceiling fan motor, motor housing, downrod, blades and blade irons, is supported by either a mounting bracket or a canopy. These mounting brackets or canopies typically include slotted openings extending from their outer edges to their centers, which are adapted to accept and retain the top end of the downrod which commonly ends in a ball joint.

When a bracket mounting system is used, the slotted mounting bracket is mounted either directly or indirectly to the ceiling at the mounting location of the anticipated connection of the ceiling fan assembly to the electrical current supply. The downrod is positioned within the slotted opening with the ball joint positioned above the slotted opening so that the downrod may be slid along the slotted opening to the mounting bracket's center and then lowered so that the ball nests upon the mounting bracket. Thus, the weight of the ceiling fan assembly is supported by the mounting bracket through the ball joint. The ceiling fan assembly is then wired to the electrical power supply wires within the ceiling. Throughout installation and wiring of the ceiling fan assembly, the canopy rests on or above the ceiling fan motor housing with the downrod extending through the center opening of the canopy. After wiring is completed, the canopy is manually raised along the downrod and is mounted to the mounting bracket to hide the mounting bracket and electrical wires from view. The slot within the bracket however may weaken the overall structure as the bracket may open or spread somewhat should an excessive force be placed upon it.

It thus is seen that a need remains for a mounting system that enables the ball joint and mounting bracket to cooperate without weakening the structure. Accordingly, it is to the provision of such that the present invention is primarily directed.

SUMMARY OF THE INVENTION

In a preferred form of the invention a mounting system for supporting a ceiling fan assembly of the type having a motor, motor housing, a plurality of blades and a downrod to a support surface. The mounting system comprises a mounting plate configured to be mounted to a support surface, a hanger coupled to the mounting plate and having a slotted ball joint receiving flange, a canopy having a central opening defined by a flange configured to nest flushly against the exterior of the hanger ball joint receiving flange, and a ball joint coupled to an end of the downrod and configured to be received within the hanger ball joint receiving flange. With this construction, the canopy restricts the ball receiving flange from spreading under a load.

DETAILED DESCRIPTION

Figure 1:
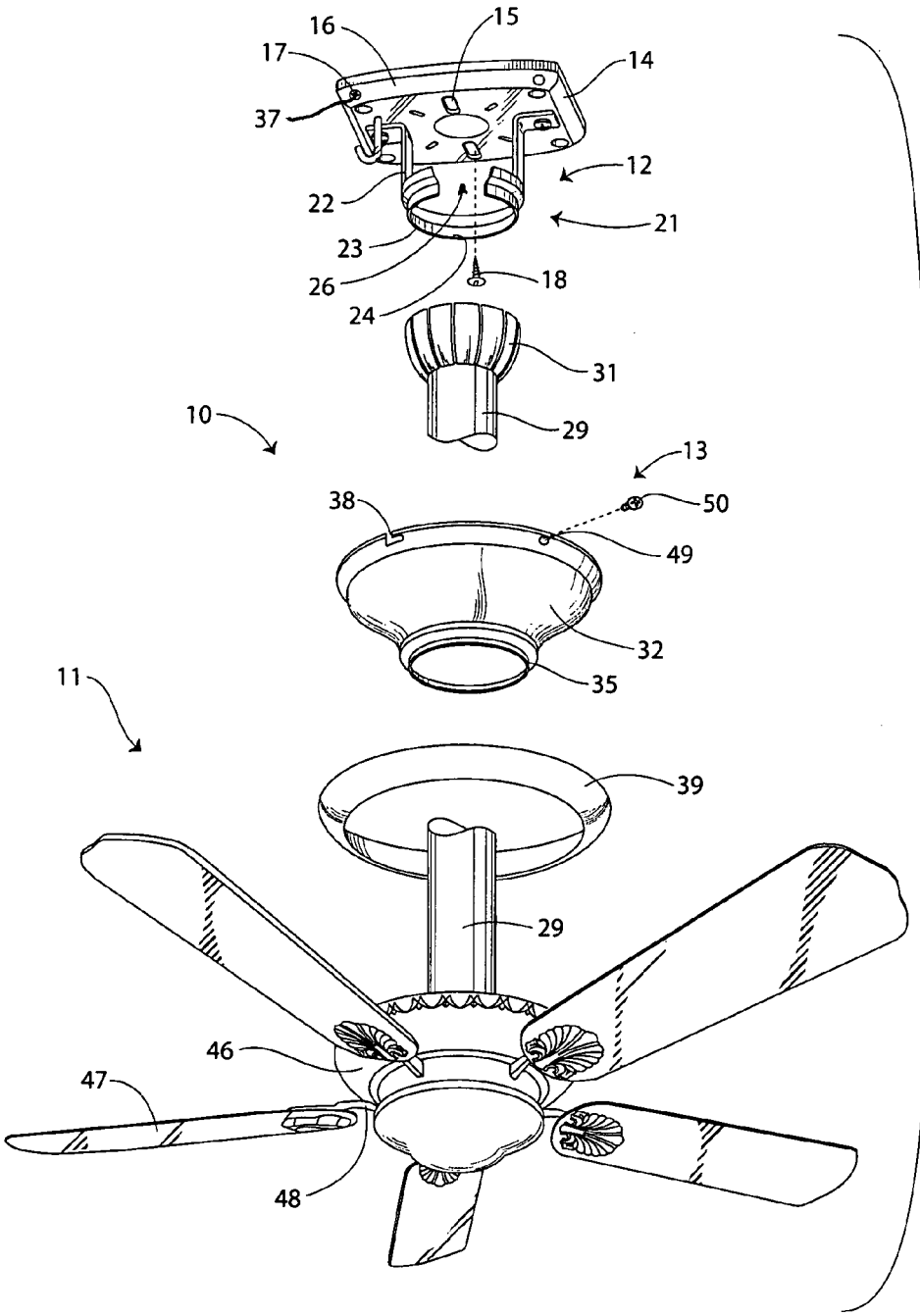
FIG. 1 is an exploded view of the ceiling fan mounting system embodying principles of the invention in a preferred form.
Figure 2:
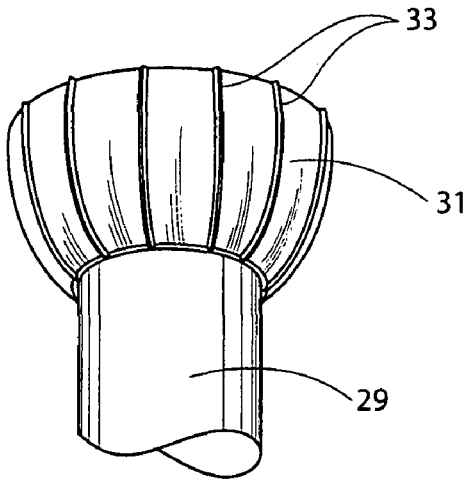
FIG. 2 is a perspective view of a ball portion of the mounting system of FIG. 1.

With reference next to the drawings, there is shown in FIG. 1 a mounting system 10 and conventional ceiling fan assembly 11 in a preferred form of the invention, shown with the mounting system 10 in an enlarged scale for clarity of explanation. The mounting system 10 includes an pre-mounted upper assembly 12 and a lower hanging assembly 13. The upper pre-mounted assembly 12 includes a mounting plate 14 with an annular array of mounting slots 15 therein and a peripheral rim or flange 16 having threaded mounting holes 17 therein. The upper assembly 12 also includes mounting screws 18 which are sized and shaped to pass through the mounting slots 15 and into the ceiling C.

The upper assembly 12 also includes a hanger or hanger bracket 21 coupled to the mounting plate 14. The hanger 21 has two mounting arms 22 and a stepped, C-shaped, ball holding flange, cradle, or nest 23 spanning the bottom ends of the mounting arms 22. The ball holding flange 23 has a beveled interior facing surface 24. The ball holding flange 23 also includes an opening or slot 26 therein which allows the passage of the downrod therethrough during mounting, as described more hereinafter.

The lower hanging assembly 13 includes a downrod 29 coupled to a ball joint 31 and a canopy 32 journalled upon the downrod 29. The term ball joint is intended to represent the enlarged portion atop the end of the downrod represented in the illustrations and is not intended to be limited to a sphere, as the ball joint may also include partial spheres, oblong or oval shapes, or symmetrical or asymmetrical structures such as the trilobular ball structure shown in U.S. Pat. No. 6,872,054. The downrod 29 has the ball joint 31 fixed to its upper end and the ceiling fan assembly 11 coupled to its lower end. The ball joint 31 is configured to be received within the hanger ball holding flange 23. The ball joint has a series of V-shaped vertical ridges 33 that extend from the lower edge to the upper edge of the ball joint. In the preferred embodiment, the ridge height is approximately 0.02 inches with the apex or bight of the V-shaped ridge being directly outwardly. The ball joint is made of nylon, such as catalog no. 101L rated 94V-2 made by E.I. DuPont de Nemours and Company, which enables a portion of the ridges 33 to be worn or deformed easily.

The canopy 32 includes a central opening defined by a central, stepped flange 35 having an interior facing surface adapted to receive and nest flushly against the exterior facing surface of the hanger ball holding flange 23. The lower hanging assembly 13 also includes mounting screws 37 adapted to extend through corresponding slotted mounting holes 38 in the canopy 32 and be threadably received within the corresponding threaded mounting holes 17 in the mounting plate flange 16. A canopy ring 39 is adapted to be coupled to the top end of the canopy 32 to obscure the mounting screws 37 from view.

The ceiling fan assembly 11 has an unshown motor, a motor housing 46, fan blades 47, and blade irons 48. The ceiling fan motor extends through an opening at the lower end of the motor housing 46. The ceiling fan blades 47 are coupled to blade irons 48 which are in turn coupled to the motor at predetermined locations depending on the desired number of fan blades 47. Although the ceiling fan assembly 11 is shown in the preferred embodiment with five blades 47, any number of fan blades 47 may be used as dictated by convention. Thus, rotational motion produced by the motor will produce air circulation through rotational movement of the fan blades 47. In order to control the speed of rotation of the fan blades 47, the motor has an unshown control switch which can be controlled conventionally through actuation of a pull string or electrical controller.

In use, the upper pre-mounted assembly 12 is installed by mounting the mounting plate 14 to the ceiling C. The mounting plate is mounted to the ceiling by extending the mounting screws 18 through the screw slots 15 in the mounting plate 14 and threading the screws 18 into the ceiling, ceiling joists or electrical box mounted to a ceiling structure or the like.

Figure 3:
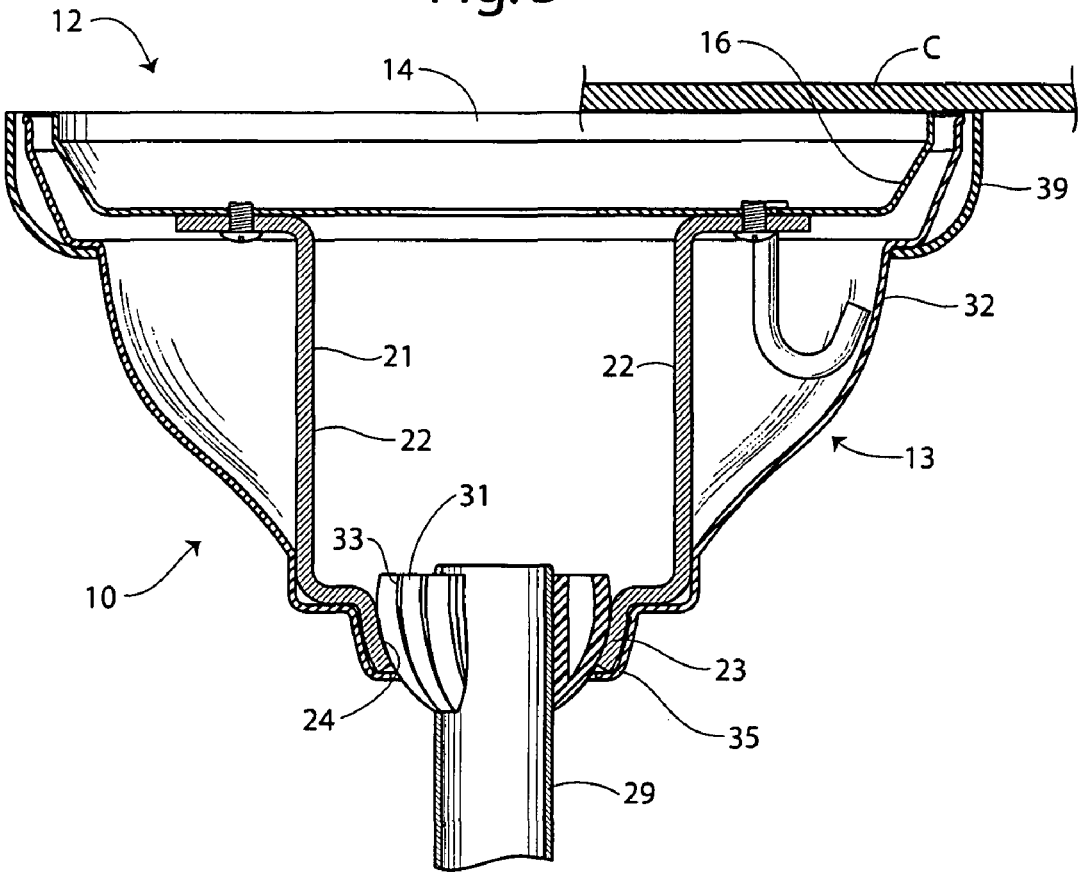
FIG. 3 is a partial cross-sectional view of the mounting system of FIG. 1.

As shown in FIG. 3, the lower hanging assembly 13 is then suspended from the upper pre-mounted assembly 12 by passing the downrod through the slot 26 and subsequently positioning the ball joint 31 within the hanger ball holding flange 23. The ceiling fan assembly 11, specifically the unshown electric wires associated with the electric motor, is then wired to the electrical wires in the ceiling. It should be noted that the installer may couple the wires without lifting the ceiling fan assembly 11 or maintaining the relative position of the ceiling fan assembly 11.

Next, the canopy 32 is raised along the downrod 29 to a position generally below and adjacent the mounting plate 14. With the threaded screws 37 mounted within the threaded screw holes 17 of the mounting plate flange 16 the canopy is raised so that the heads of the screw 37 pass through the large portion of the slotted mounting holes 38. The canopy is then rotated clockwise so that the heads of the screw 37 are positioned in the narrow portion of the mounting holes 38 and tightened to prevent the canopy from falling. The canopy and mounting plate may also include a circular mounting hole 49 and corresponding screw 50 which further prevents the canopy from rotating counterclockwise and thereby releasing from the mounting plate.

The canopy stepped flange 35 fits flushly against the exterior of the hanger ball holding flange 23 so as to encircle the C-shaped holding flange 23. This configuration restricts the holding flange 23 from spreading out or expanding in size (the slot becoming wider) due to a load placed upon the holding flange 23 through ball joint 31. This spreading out can cause the ball joint to slip through a conventional C-shaped ball holding flange. By surrounding the ball holding flange with the canopy flange 35 it has been found that the force required to cause the spreading of the holding flange has increased from approximately 300 pounds, associated with prior art design, to approximately 800 pounds. Of course, the strength of the holding flange is contingent upon its size and materials from which it is made. The substantial increase in the capability to support a heavy load upon the holding flange provides a great safety advantage.

During operation of the ceiling fan slight vibrations and other movements cause the ball joint 31 to move relative to the hanger ball holding flange 23. This movement and the weight of the fan itself cause the V-shaped ridges 33 of the ball joint to be worn down or deformed. The term deformable used herein is intended to mean the wearing away of, compression, or physical deflection of the ridges. This deformation of the ridges 33 causes the ball joint 31 to fit tight within the holding flange 23, even correcting some tolerance discrepancies between such. The ridges of the preferred embodiment are intended to be worn approximately 0.01 inches wherein the ridge becomes wider resulting in a reduction of its wearing. As such, the ball joint ridges 33 allows for a better fit between the ball joint and the holding flange, an improvement over the prior art wherein variations therebetween may cause fit related problems between the smooth surfaces of the ball joint and their receiving member.

It thus is seen that a mounting system for supporting a ceiling fan assembly is now provided which provides greater load holding characteristics between the ball joint and the ball joint holding flange. It should be understood that many modifications may be made to the specific preferred embodiment described herein without departure from the spirit and scope of the invention as described by the following claims.

The invention claimed is:

1. A mounting system for supporting a ceiling fan assembly of the type having a motor, motor housing, a plurality of blades and a downrod to a support surface, the mounting system comprising;

a mounting plate configured to be mounted to a support surface;

a hanger coupled to said mounting plate, said hanger having a slotted ball joint receiving flange having an upright annular sidewall with an annular, stepped exterior facing sidewall surface, a canopy having a central opening defined by a flange having an annular upright, stepped interior facing sidewall surface configured to nest flushly against said annular exterior facing sidewall surface of said hanger ball joint receiving flange, and a ball joint coupled to an end of the downrod and configured to be received within said hanger ball joint receiving flange, whereby the canopy restricts the ball receiving flange from spreading under a load.

2. The mounting system of claim 1 wherein said slotted ball joint receiving flange is C-shaped.

3. A The mounting system for supporting a ceiling fan assembly of the type having a motor, motor housing, a plurality of blades and a downrod to a support surface, the mounting system comprising;

a hanger adapted to be coupled to a support surface, said hanger having a ball joint receiving flange having an annular sidewall with an annular, stepped exterior facing sidewall surface, and a ball joint coupled to an end of the downrod, said ball joint being configured to be received within said hanger ball joint receiving flange; and a canopy having a hanger receiving flange having an annular, stepped interior facing sidewall surface configured to fit flush against and encircle said hanger ball joint receiving flange annular exterior facing sidewall surface, whereby the canopy hanger receiving flange restricts the hanger ball joint receiving flange from expanding.

4. A mounting system for of claim 3 wherein said hanger ball joint receiving flange is C-shaped.

5. The mounting system of claim 3 further comprising a mounting plate, and wherein said hanger is coupled to said mounting plate.

6. The mounting system of claim 5 wherein said hanger ball joint receiving flange is C-shaped.

7. A mounting system for supporting a ceiling fan comprising;

an upper assembly mounted to a support surface and a lower assembly coupled to said upper assembly, the upper assembly including a slotted cradle with a sidewall having an annular upright, stepped exterior facing surface, said lower assembly including a canopy having an opening flange with an annular upright, stepped interior facing sidewall surface configured to fit flush against said slotted cradle annular exterior facing surface, the lower assembly also including a ball joint coupled to an end of a downrod, said ball joint being configured to be received within said cradle, whereby the canopy flange restricts the cradle from spreading under a load.

8. The mounting system of claim 7 wherein said upper assembly also includes a mounting plate and wherein said cradle is coupled to said mounting plate.

9. The mounting system of claim 7 wherein the slotted cradle is a C-shaped cradle.

* * * * *